United States Patent [19]

Arrington

[11] 3,989,302

[45] Nov. 2, 1976

[54] CONTINUOUS ROOF SUPPORT SYSTEM FOR TUNNEL BORING

[75] Inventor: Thomas Lonnie Arrington, Beaumont, Tex.

[73] Assignee: Dresser Industries, Inc., Dallas, Tex.

[22] Filed: July 25, 1975

[21] Appl. No.: 599,194

[52] U.S. Cl. ..... 299/11; 61/85; 299/33

[51] Int. Cl.[2] ..... E21D 9/08

[58] Field of Search ..... 299/11, 31, 33; 61/42, 61/45 R, 84, 85

[56] References Cited

UNITED STATES PATENTS

| | | | |
|---|---|---|---|
| 2,925,258 | 2/1960 | Robbins | 299/31 |
| 3,061,287 | 10/1962 | Robbins | 299/31 |
| 3,600,899 | 8/1971 | Watson et al. | 61/85 |
| 3,640,077 | 2/1972 | Watson et al. | 61/85 X |
| 3,800,549 | 4/1974 | Lobbe | 61/85 |
| 3,823,566 | 7/1974 | Handewith | 61/85 |
| 3,903,707 | 9/1975 | Folk | 61/85 |

*Primary Examiner*—Ernest R. Purser
*Attorney, Agent, or Firm*—Eddie E. Scott

[57] ABSTRACT

The roof of a tunnel being bored by a tunneling machine is continuously supported, using sections of lagging and ring beams. A shield is positioned over the earth boring machine. The shield includes a multiplicity of elongated members. The elongated members provide elongated recesses that will accommodate sections of lagging. A length of tunnel is bored, and a ring beam is implanted in the tunnel beneath the shield. The lagging may be manipulated in the elongated recesses in the shield and positioned proximate the roof of the tunnel supported by the ring beam. Additional lagging is provided by repeating the steps.

4 Claims, 3 Drawing Figures

CONTINUOUS ROOF SUPPORT SYSTEM FOR TUNNEL BORING

BACKGROUND OF THE INVENTION

The present invention relates to the art of earth boring and, more particularly, to a system for continuously lagging a tunnel formed by an earth boring machine.

During the boring of a tunnel, serious problems are often encountered because portions of the roof behind the cutterhead tend to cave onto the tunneling machine and into the area behind the tunneling machine, damaging equipment and creating a substantial hazard for personnel in the area. In order to overcome this problem, lagging consisting of short lengths of timber, sheet steel, concrete slabs, or the like are used to secure the roof. This lagging forms a permanent roof support and protects personnel and equipment behind the tunneling machine. The lagging may be in the form of a solid layer of material, or it may be what is known as finger lagging, wherein substantial gaps are located between adjacent sections of lagging.

Prior to applicant's present invention the rock and earth formations above the roof of the tunnel between the cutterhead and the lagging in place were unsupported and would tend to fall onto the machine or into the tunnel behind the machine. In addition, prior to applicant's present invention, personnel installing the lagging had to venture into an area where the roof was not supported. It is difficult to provide lagging directly above the tunneling machine while drilling is in progress. Thus, there is a danger of rock and portions of the formations falling from the crown of the tunnel onto the machine or on workers operating the machine and/or attempting to put lagging in place. Some tunneling machines have included shields above the machine body; however, the area between the end of the shield and the lagging in place is unsupported.

The present invention overcomes these problems by providing a continuous lagging system that will operate effectively while drilling is in progress. The operating personnel and machinery are provided with continuous protection from broken ground falling out of the tunnel roof. Permanent roof support systems are installed behind the machine and the invention affords continuous protection for the workmen installing the permanent roof support structures. The invention eliminates the danger zone just behind the cutterhead to the first permanent roof support by providing a smooth transition of roof load from the machine rock shield to the tunnel support rings.

DESCRIPTION OF PRIOR ART

In U.S. Pat. No. 3,870,368 to Douglas F. Winberg and Norman D. Dyer, patented Mar. 11, 1975, a tunneling shield is shown. The tunneling shield is for shielding the area of a tunnel between first and second tunnel machine assemblies which are longitudinally, relative to the axis of the tunnel, movable relative to each other comprising a plurality of extendable and retractable support beams, the longitudinal axes of which are substantially parallel with the axis of the tunnel. The support beams may be disposed near the wall of the tunnel at circumferentially spaced intervals from each other and connected at each end to a first and second tunnel machine assembly by flexible joints. Each of the support beams may comprise first and second telescopically engageable members to effect extension and retraction of the support beams in response to relative movement between the first and second machine assemblies.

SUMMARY OF THE INVENTION

The present invention provides a system for continuously supporting the roof of an excavation by providing a shield over the earth boring machine and continuously providing lagging behind the machine. The shield includes space for sections of the lagging. After a section of the excavation has been bored, a support beam is placed in the excavation. The lagging may then be positioned proximate the roof of the excavation and supported by the support beam. The space in the shield allows the lagging to be easily moved into place. Additional lagging is provided by repeating the steps. The above and other features and advantages of the present invention will become apparent from a consideration of the following detailed description of the invention when taken in conjunction with the accompanying drawings.

DETAILED DESCRIPTION OF THE INVENTION

Figure 1:
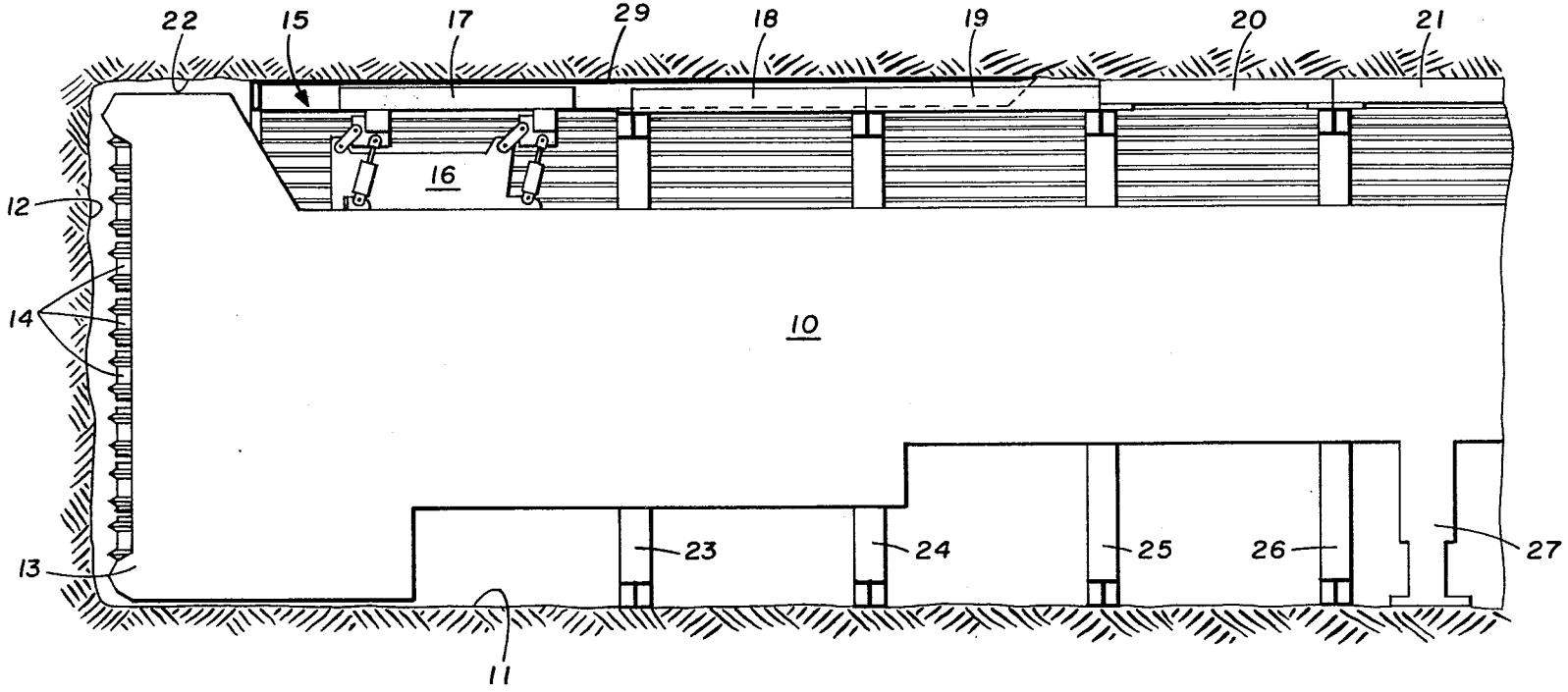
FIG. 1 is an illustration of a side view of a tunnel with a tunnel boring machine including a shield positioned in the tunnel and lagging being positioned to support the roof of the tunnel.

Referring now to the drawings and in particular to FIG. 1, the silhouette of an earth boring machine generally designated by the reference number 10 is shown positioned in a tunnel 11. The earth boring machine 10 includes a rotary cutterhead 13 and a support leg 27. A multiplicity of rolling cutters 14 are mounted on the cutterhead 13. The cutters 14 contact and disintegrate the formations at the face 12 of the tunnel 11. Immediately behind the cutterhead 13 is a shield 15 positioned above the body of the tunneling machine 10. The shield 15 is supported by a brace plate 16 attached to the body of the tunneling machine 10. Lagging, such as the section of lagging 17, may be positioned in recesses in the shield 15. A ring beam 23 is implanted in the tunnel 11 and as the tunneling machine 10 moved forward, the lagging may be moved into place on the ring beam 23 and ring beam 24 to support the roof 22 of the tunnel. As shown in FIG. 1, ring beams 24, 25 and 26 have been put in place and sections of lagging 18, 19, 20 and 21 moved into place between the roof 22 of the tunnel 11 and the ring beams 24, 25 and 26. Wedges may be driven between the sections of lagging 20 and 21 and ring beams 25 and 26 respectively to force the lagging out into contact with the roof of the tunnel and provide support. The sections of lagging 17, 18 and 19 are still under the shield 15 and have not yet been moved out into contact with the roof 22 of the tunnel 11. It will be appreciated that the lagging may be locked in place in other ways such as by rock bolts or the like.

Figure 2:
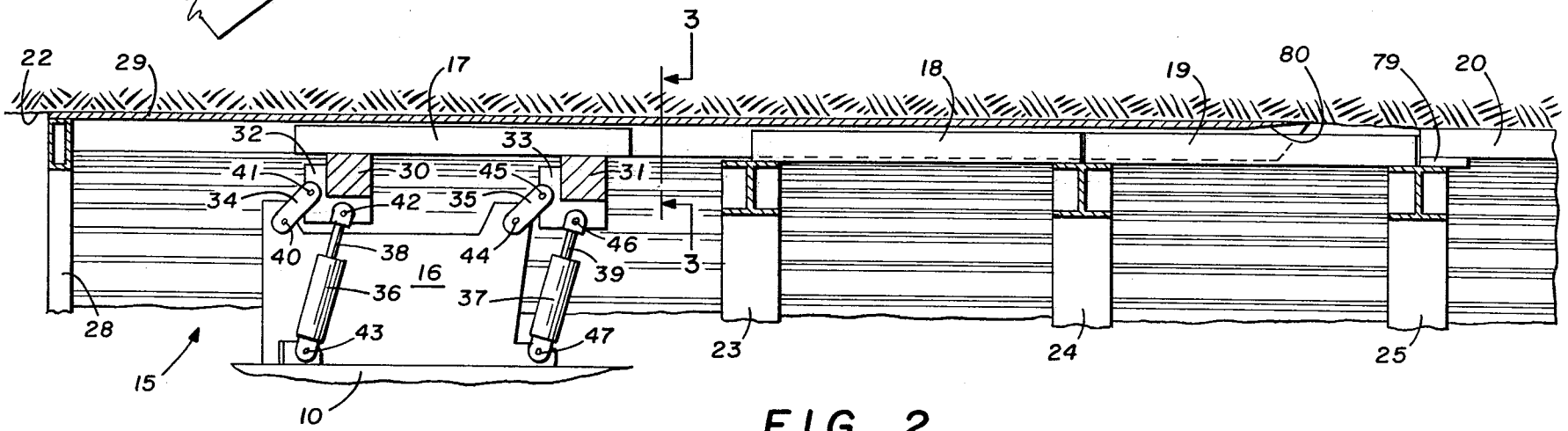
FIG. 2 is an enlarged view of the shield and a portion of the lagging shown in FIG. 1.

Referring now to FIG. 2, an enlarged view of a portion of the shield 15 is shown. The shield 15 consists of a multiplicity of generally T-shaped elements 29. The T-shaped elements are formed by a pair of inverted L-shaped elements as will be described hereinafter. The T-shaped members 29 are connected to an end beam 28 and a pair of shield support beams 30 and 31. A pair of thrust cylinders 36 and 37 provide the force for moving the shield 15 out into contact with the roof 22 of the tunnel. Plates 32 and 33 are connected to the shield support beams 30 and 31, respectively. A hinge link element 34 is connected between the plate 32 and the brace plate 16. The hinge link element 34 is connected to the plate 32 by pin 41 and connected to the brace plate 16 by the pin 40. A hinge link element 35 is connected between the plate 33 and the brace plate 16. The hinge link element 35 is connected to the plate 33 by a pin 45 and connected to the brace plate 16 by a pin 44. The cylinder 36 is connected to a projection of plate 16 by a pin 43. The piston rod 38 extends from the cylinder 36 and is connected to the plate 32 by a pin 42. The cylinder 37 is connected to the brace plate 16 by a pin 47. A piston rod 39 extends from the cylinder 37. Piston rod 39 is connected to the plate 33 by a pin 46.

Expansion of the cylinders 36 and 37 causes the shield 15 to swing upward into place against the roof 22 of the tunnel. Contraction of the cylinders 36 and 37 moves the shield away from the roof 22 of the tunnel. The hinge link elements 34 and 35 rotate about the respective pins allowing the shield to swing up into place and back to the retracted position. The combination of hinge link elements and thrust cylinders effectively supports the shield and allows the forces created by movement of the shield along the roof of the tunnel to be transferred to the body of the tunneling machine without damaging the thrust cylinders. Horizontal forces are substantially taken by the hinge link elements whereas vertical forces are taken and provided by the thrust cylinders. The combination of hinge link elements and thrust cylinders also allows the shield to swing back into the retracted position free from any impediments encountered along the roof of the tunnel.

The ends of the T members 29 of shield 15 are tapered, as shown by the taper 80. This allows the lagging sections, such as lagging section 19, to be moved upward into place against the roof 22 of the tunnel immediately after the end of the section of lagging 19 emerges from the shield 15. The lagging may be moved out against the roof 22 of the tunnel by wedge members that are driven between the ring beams and the lagging or by other means. For example, the lagging section 20 has been driven out into contact with the roof 22 of the tunnel by the wedge element 79 positioned between the lagging 20 and the ring beam 25.

Figure 3:
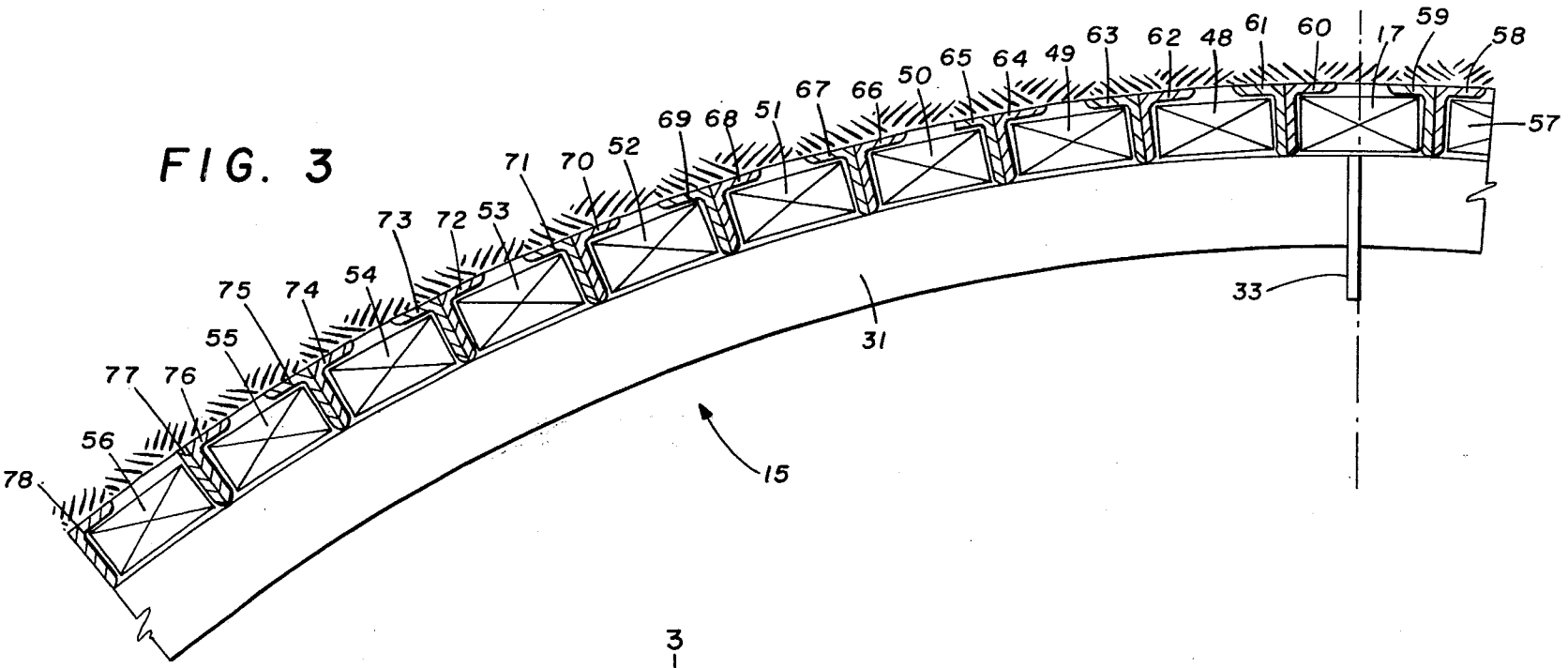
FIG. 3 is a section of the shield taken along lines 3—3 in FIG. 2.

Referring now to FIG. 3, a section of a portion of the shield 15 is shown taken along lines 3—3 of FIG. 2. The support beam 31 supports the sections of lagging. The plate 33 is connected to the support beam 31. The T-shaped elongated support members are formed by individual inverted L-shaped members positioned back to back. For example, members 58 and 59 form one of the elongated T-shaped members. In the same fashion, elements 60 and 61 form another T-shaped member located substantially parallel to the T-shaped member formed by elements 58 and 59. Other L-shaped member 62-76 are connected to the support beam 31 and form pockets or recesses for receiving the individual sections of lagging 48-55. An element 77 is connected to the element 76. The element 77 does not have a projecting flange. Element 77 in combination with element 78 forms a pocket or recess for receiving the section of lagging 56.

The absence of the projecting flange on element 77 allows rock bolts to be easily emplaced through the shield 15. It will also be appreciated that when the sections of lagging 57, 17 and 48-56 are not being stored in the shield 15, it is possible to view portions of the formations shield 15. This provides a distinct advantage during drilling because the formations can be observed as the tunneling machine moves forward. As the tunneling machine enters formations that will not support themselves, fractures and loose pieces of rock can be detected by looking through the shield 15. When this happens, rock bolts can be emplaced in the formations to help support the roof of the tunnel. The rock bolts can be drilled into place directly through the openings in the shield. It is possible to use support plates on the rock bolts within the pockets between the T-shaped members. As these plates emerge from the shield 15, the rock bolts can be tightened to pull the support plates up into contact with the roof. The roof is continuously supported and there is no opportunity for sections of the formation to pull away from the roof.

Once the tunneling machine 10 enters an area where the roof 22 of the tunnel must be supported by lagging, sections of lagging may be moved into place entirely within the protection of the shield 15. The thrust cylinders 36 and 37 maintain the shield 15 in a position proximate the formations. Loose rock is prevented from falling onto the tunneling machine 10 and endangering personnel in the area. Ring beams are positioned in the tunnel 11 and as the tunneling machine 10 advances forward, sections of lagging may be moved into place on the ring beams. Wedges may then be driven between the lagging and the ring beams to force the lagging into contact with the roof or the lagging locked in place in some other fashion. The roof of the tunnel may be lagged with sections of lagging immediately adjacent each other or spaces may be left between lagging, depending on the nature of the support required. The present invention provides continuous support to the formations uninterrupted by gaps that would create a danger zone where loose rock could fall into the tunnel. The formations can be viewed through the shield immediately behind the cutterhead. The shield may be extended upward into contact with the formations, when it appears the formations need support. Rock bolts can be inserted into the formations where necessary through the shield. When it becomes necessary to install lagging, the lagging can be moved into place without leaving an unsupported area of the roof. The shield also includes storage space where sections of lagging may be loaded prior to the time they will be moved into place on the ring beams.

The embodiments of the invention in which an exclusive property or privilege is claimed are defined as follows:

1. An earth boring machine for boring a tunnel is subterranean formations and providing support for the roof of the tunnel using sections of lagging and support beams, comprising:

a machine body section;

a rotary cutterhead connected to the machine body section for contacting and disintegrating the subterranean formations; and shield means projecting from said machine body section, said shield means located immediately behind said rotary cutterhead, for temporarily supporting the roof, said shield means including a multiplicity of parallel beams spaced apart leaving openings between beams, said beams including a downward projection with the space between the downward projections being slightly larger than said sections of lagging whereby a section of lagging may be accommodated and moved into place on the support beams.

2. A method of tunneling and supporting the roof of a tunnel being bored by a tunneling machine, using sections of lagging and support beams, said tunneling machine having a shield positioned above the machine with space in said shield for sections of lagging, comprising the steps of:

loading sections of said lagging in said space in said shield;

boring a length of tunnel thereby moving said machine, said shield and said lagging forward in said tunnel;

placing a support beam in said tunnel beneath said shield;

moving said sections of lagging from said space in said shield onto said support beam beneath said shield;

loading additional sections of said lagging in said space in said shield;

boring an additional length of tunnel thereby moving said machine, said shield and said lagging forward in said tunnel;

placing an additional support beam in said tunnel beneath said shield; and moving said additional sections of lagging from said space in said shield onto said additional support beam beneath said shield.

3. A method of tunneling and supporting the roof of a tunnel being bored by a tunneling machine, using sections of lagging and support beams, said tunneling machine having a shield positioned above the machine with space in said shield for sections of lagging, comprising of steps of:

placing sections of said lagging in said space in said shield;

boring a length of tunnel thereby moving said shield and lagging forward in said tunnel;

placing support ring beam means in said tunnel;

moving said lagging from said space in said shield onto said support ring beam means;

placing additional sections of said lagging in said space in said shield;

boring an additional length of tunnel thereby moving said shield and lagging forward in said tunnel;

placing additional support ring beam means in said tunnel; and moving said additional sections of lagging from said space in said shield onto said additional support ring beam means.

4. An earth boring machine for boring a tunnel in subterranean formations and providing support for the roof of the tunnel using sections of lagging and support beams, comprising:

a machine body section;

a rotary cutterhead connected to the machine body section for contacting and disintegrating the subterranean formations;

shield means positioned over said machine body section for temporarily supporting the roof, said shield means including a multiplicity of parallel beams spaced apart leaving openings between beams;

said beams including a downward projection with the space between the downward projections being slightly larger than said sections of lagging whereby a section of lagging may be accommodated and moved into place on the support beams;

at least one link element rotatably connected to said machine body section and rotatably connected to said shield means, said link element and said shield means adapted to be moved upward toward said roof and toward said rotary cutterhead; and thrust cylinder means connected between said machine body section and said shield means whereby actuation of said thrust cylinder means will move said shield means toward said roof and toward said rotary cutterhead.

* * * * *

UNITED STATES PATENT OFFICE

CERTIFICATE OF CORRECTION

Patent No. 3,989,302 Dated November 2, 1976

Inventor(s) Thomas Lonnie Arrington

It is certified that error appears in the above-identified patent and that said Letters Patent are hereby corrected as shown below:

Column 5, line 40, delete first occurrence of "of" and insert -- the --.

Signed and Sealed this

Eleventh Day of January 1977

[SEAL]

*Attest:*

RUTH C. MASON
*Attesting Officer*

C. MARSHALL DANN
*Commissioner of Patents and Trademarks*